US007353577B2

(12) United States Patent
Davies et al.

(10) Patent No.: US 7,353,577 B2
(45) Date of Patent: Apr. 8, 2008

(54) SYSTEM AND METHOD FOR CASTING TOILET BOWLS

(76) Inventors: Graham Davies, 416 Pine Creek Rd., Exton, PA (US) 19341; Benjamin M. Ferrer, 112 Country Drive, Country Homes, Binan, Laguna (PH)

( * ) Notice: Subject to any disclaimer, the term of this patent is extended or adjusted under 35 U.S.C. 154(b) by 0 days.

(21) Appl. No.: 11/672,759

(22) Filed: Feb. 8, 2007

(65) Prior Publication Data

US 2007/0124913 A1 Jun. 7, 2007

Related U.S. Application Data

(62) Division of application No. 10/726,271, filed on Dec. 2, 2003, now Pat. No. 7,263,758.

(51) Int. Cl.
*B21B 1/46* (2006.01)

(52) U.S. Cl. ..... 29/33 C; 29/401.1; 4/300; 264/86; 156/89.11

(58) Field of Classification Search ..... 29/33 C, 29/401.1, 822, 890.14, 890.141, 428, 527.1, 29/527.3; 4/420, 329, 421, 300; 264/250, 264/299, 86; 249/58; 425/405.2, 451, 253; 156/89.11

See application file for complete search history.

(56) References Cited

U.S. PATENT DOCUMENTS 1,289,151 A * 12/1918 Gavin ..... 264/250
1,337,663 A * 4/1920 Lawrence et al. ..... 249/58
1,435,644 A * 11/1922 Kelly ..... 264/250
1,447,529 A * 3/1923 Bowers ..... 264/86
3,218,376 A * 11/1965 Schindler, Jr. et al. ..... 264/86
3,461,194 A * 8/1969 Alexander ..... 264/86
3,536,799 A * 10/1970 McQueen Spy ..... 264/86
3,664,799 A * 5/1972 Wallick ..... 425/405.2
3,843,977 A * 10/1974 Garnett ..... 4/421
3,852,017 A * 12/1974 Derror ..... 425/451
4,145,772 A * 3/1979 Whitney et al. ..... 4/300
4,982,454 A * 1/1991 Saltel et al. ..... 4/300
5,268,047 A * 12/1993 Chuang ..... 156/89.11
5,514,316 A * 5/1996 Kosugi et al. ..... 264/86
6,428,643 B1 * 8/2002 Bergquist et al. ..... 156/89.11

* cited by examiner

*Primary Examiner*—Dana Ross
(74) *Attorney, Agent, or Firm*—Kelly Merkel

(57) ABSTRACT

The present invention provides an improved system and method for casting toilets. In the disclosed method, at least one of a shell, engine and rim configuration for a toilet is provided, wherein the configuration is selected from a plurality of shell, engine and rim configurations defined by a corresponding plurality of shell, engine and rim molds. Each mold defines a casting space therewithin for casting the selected configuration therefrom. Each shell configuration includes a hollow housing space for disposition of a unique sanitaryware performance engine configuration therewithin. While still greenware, the cast engine is disposed in the shell housing space to form at least one shell and engine assembly thereby. Subsequently, and while also in a green state, the cast rim is assembled with the shell and engine assembly and the entire shell, engine and rim assembly is fired to form a single integral piece of sanitaryware. In the corresponding system, a series of casting stations is provided that defines a casting sequence, wherein each said station performs a specific casting step. The selected configuration is sequentially directed to at least one station selected from the series of stations where at least one casting step is performed. Sequential direction and casting steps are repeated until a predetermined number of toilets are produced.

12 Claims, 15 Drawing Sheets

SYSTEM AND METHOD FOR CASTING TOILET BOWLS

This is a divisional application of U.S. application Ser. No. 10/726,271 filed on Dec. 2, 2003 now U.S. Pat. No. 7,263,758 and published as U.S. Publication No. 20050115042 on Jun. 2, 2005.

FIELD OF THE INVENTION

The present invention is directed to an improved system and method for casting sanitaryware and the sanitaryware produced thereby. In particular, the present invention is directed to an improved system and method for casting single-piece toilet bowls using a multi-piece construction wherein multiple bowl designs are interchangeable with multiple trapway embodiments. In this manner, manufacturers can achieve a plurality of toilet bowl designs having varying aesthetic characteristics. Such designs are assembled with varying functional embodiments that satisfy local regulatory standards and performance expectations, thereby simplifying manufacturing and improving yields without detrimental effects to the toilet bowl's appearance as a single-piece member.

BACKGROUND OF THE INVENTION

Sanitaryware manufacturers often employ prevalent slip casting processes for the manufacture of china fixtures such as toilets, lavatories and pedestals. In general, during a slip casting process, the manufacturer prepares a slurry, or "slip", by combining clay powder in a suspending liquid. The caster adds deflocculants (for instance, sodium silicate, sodium carbonate or a combination thereof) to the slurry for stability and density and further adds binders to provide further structural strength to the resulting cast. The manufacturer derives the slip from one or more clay recipes, taking into consideration factors such as material price, casting rate, consistency (with respect to particle size, surface area, casting rate, viscosity and gel structure formation), purity and low deflocculant demand. The manufacturer may vary the slurry's chemical composition to attain desirable aesthetic and performance characteristics in the finished product and also to meet the particular operating parameters of the manufacturer's equipment and casting techniques.

The caster subsequently introduces liquid slip into a mold either by gravity or by pressure from a pump. The mold sections are made from plaster of Paris or similar porous material that enables capillary absorption of water from the slip. The capillary action of the plaster mold draws the water out of the slip, and the remaining clay forms a shell that becomes the cast piece (also known as a green piece). In pressure casting, liquid slip enters a resin filter under high pressure (typically hydraulic pressure), thereby forcing water out of the slip into the filter. The pore size of the filter material is such that the clay remains on the surface of the filter to form the cast piece. In either method, the thickness of the cast piece is dependent upon a variety of factors including, but not limited to, the chemical composition of the slip, plant temperature, relative humidity, cast time, sulfate content, viscosity of the slip (initial and build up), thixotropy (viscosity versus time), slip cake weight, filtrate weight, moisture gradient and slip temperature. Upon absorption of a sufficient amount of water, the caster removes the greenware from the molds whereupon it is dried, glazed and fired. Throughout this application, "slip casting" shall include both gravity and pressure casting methods.

Manufacturers realize several advantages with slip casting processes, such as superior mold life and recovery, the ability to finish articles while they are drying and the ability to utilize workers of similar skill level. Manufacturing methods can be changed without replacing current personnel and without significant additional investments in capital expenditures and technical expertise. Pressure casting realizes an additional productivity benefit by creating a greater product volume per square foot of manufacturing floor space.

Slip casting, however, remains a capital-intensive process. The production of sanitaryware requires significant space to accommodate a limited number of molds alongside expensive equipment maintained by highly skilled personnel. Mold making technology is often proprietary, ensuring costly reliance upon mold manufacturers to modify molds and creating consequential manufacturing delays. Also, some equipment suppliers limit the chemistry used in the slip and thereby make it difficult to find suitable slips for certain molds.

In addition, slip casting comprises several time consuming and labor-intensive aspects. The slip casting industry still depends largely upon human expertise and judgment to make improvements in casting processes. The wage rate for a skilled caster is therefore fairly high, and a long training period is required to ensure proper skill levels. Due to the large intervention of human judgement, cracks and other defects in the cast often manifest themselves in the final product. Numerous other factors inhibit the uniform production of casts, such as differences in casting times, variations in ambient temperature and humidity (wherein such variations occur among different manufacturing facilities or within a single facility) and the age and condition of the molds (as the age of the mold increases, the capillary action of the mold degrades and the mold becomes saturated with water). Although manufacturers often recover and reuse materials at the cost of associated labor and overhead, most defects that are found after firing result in lost materials and up to 30% scrap and rework for manufacturers (see Kimberly L. Petri and Alice E. Smith, "A Hierarchical Fuzzy Model for Predicting Casting Time in a Slip Casting Process").

In order to reduce manufacturing and temporal costs inherent in most slip casting procedures, sanitaryware manufacturers have long sought enhancements in such processes, particularly due to the complex configuration of toilets and the inherent propensity for production losses. Fashionable designer products such as toilet bowls have large hollow areas comprising the shroud or shell. Large hollow areas are problematic, since the timing of the draining and setting must be consistent to avoid the appearance of cracks at the green stage.

U.S. Pat. No. 1,289,151 discloses a process of casting a toilet bowl in which the manufacturer casts a part of the bowl below a curved plane lying along the upsiphon passageway. The manufacturer simultaneously casts a portion of the bowl lying above this plane and subsequently secures the two parts to on another.

U.S. Pat. No. 1,337,663 discloses a mold for manufacturing a toilet bowl having a mold and core made of an absorbent material such as plaster. A portion of the core is covered with a nonabsorbent material to prevent formation of a crust of clay thereadjacent.

U.S. Pat. No. 1,435,644 discloses a method of constructing an earthenware bowl with a flushing rim. In the disclosed method, the bowl and outer section of the rim are formed together, the top and inner skirting of the rim are formed separately and the top of the rim is subsequently united with the upper marginal edge of the outer rim section.

U.S. Pat. No. 1,447,529 discloses a process for making a toilet having an integral bowl and base. In the disclosed process, liquid slip is poured between an external mold body and an absorbent internal mold core. The mold and core are spaced from one another by a distance equal to the thickness of the wall of the finished product. The caster inverts the mold during the pouring of the slip, thereby permitting the slip to flow laterally and form a base of the toilet subsequent to the formation of the bowl.

U.S. Pat. No. 3,218,376 discloses a method of casting a toilet bowl having an integral flushing ring. The disclosed method employs a multiple part porous mold for the bowl and flushing ring and a removable moisture-absorbent insert fitted upon a core. The fitted core is inserted into the mold so as to underlie the flushing ring when formed. Slip is poured into the mold and insert to form the bowl and flushing ring. The core is subsequently separated from the mold and insert, and the cast bowl with flushing ring is fired.

U.S. Pat. No. 3,461,194 discloses a method of casting siphonic toilet bowl with an integral flushing ring. The method includes setting up an inverted main core mold and disposing a series of separate core pieces therearound. The pieces have outwardly projecting, spaced, flexible members to form discharge passages in the cast flushing ring. The main core and pieces are assembled with a shell mold and a foot mold and slip is poured into the main core mold. Excess clay is drained from the mold after deposition of clay thereon, thereby allowing the casting to set. The main core and pieces are removed from the cast piece, wherefore the cast piece is subsequently finished, dried and fired.

U.S. Pat. No. 3,536,799 discloses a method of continuous flow casting of vitreous china articles in molds. In the disclosed method, a plurality of molds is provided, each of which includes a face part and a cover part. The molds are consecutively arranged upright in a substantially vertical plane. The horizontal axis of each mold tilts downwardly toward an inlet in the lowermost part of the mold. Slip is injected into the molds and flows through the mold during casting to an outlet defined at the highest point of each mold. After casting, the face part is removed in a horizontal plane, as is the cast product.

U.S. Pat. No. 5,268,047 discloses a method of producing toilet assemblies having different size drainpipes. In the disclosed method, a common mold is provided for molding a plurality of identical toilet bowls and a plurality of different molds are provided for molding a plurality of drainpipes of varying size. Multiple molded toilet bowls are joined with corresponding drainpipes and sealed at the joint therebetween to form a plurality of toilet bowl assemblies. The assemblies are air-seasoned, glazed and fired to produce finished assembled having drainpipes of different sizes.

U.S. Pat. No. 5,514,316 discloses a method of casting a ceramic article, wherein a porous casting mold is provided that includes a mold cavity with a green ceramic body placed thereinside. Slip is supplied to the mold cavity and forms a deposit upon an inner surface of the mold, thereby integrating the green ceramic body and the deposit into a single ceramic body. The green ceramic body and the slip are substantially the same in composition, and the water content of the green ceramic body approximates a water content of the slip so as to prevent the green ceramic body from swelling.

U.S. Pat. No. 6,428,643 discloses a method and apparatus for casting toilets in which the bowl and rim are separately molded and subsequently joined while both are inverted. During connection of the rim and bowl, two opposing sides of the mold support the bowl, and an inverted rim has slip material applied to its lower surface. A trolley raises the rim so that the bottom surface of the rim engages the top surface of the bowl when both are upside down, thereby resulting in a cast greenware toilet.

None of the aforementioned references discloses solid cast prefabricated pieces that are separately cast and subsequently assembled to produce a variety of highly complex models from a single platform. Integration of platforms in manufacturing strategies is well known in several industries for implementing common underlying structure as the basis for multiple, varying products. In the automotive industry, for instance, a "platform" refers to a vehicle's suspension, drive train and structural components. Auto manufacturers having multiple divisions use platforms to produce similar models under different nameplates, thereby supporting common design themes while satisfying consumer loyalty to specific brand names. A single manufacturer may only have four platforms yet manufacture over 30 different vehicles around the world. Dependence upon platforms therefore enables auto manufacturers to market substantially similar vehicles to different market segments while recovering research and development costs.

The platform concept is similarly applicable in sanitaryware manufacturing for the manufacture of solid cast prefabricated pieces that can be assembled to produce a variety of bowl configurations from a single platform. Such a process would improve manufacturing yields and enable accelerated production of complex bowls designs by using the toilet's functional components (i.e., the trapway, jet and inlet and outlets) as the basis for a plurality of toilet models. It is desirable to modify such functional components according to the regulatory requirements and plumbing configurations of the geographic region in which the bowl is sold. Therefore, a single manufacturing facility can easily produce toilets for consumers of the region in which the manufacturing facility is located as well as for multiple global regions without substantial capital expenditures in new manufacturing facilities and new equipment to modify entire models according to local regulations and aesthetic tastes.

It is therefore desirable to provide interchangeable platforms in the manufacture of sanitaryware to achieve a plurality of design and functional combinations.

SUMMARY OF THE INVENTION

It is an advantage of the present invention to expedite and simplify the manufacture of complex toilet bowl designs by using a common platform to produce a variety of toilet bowl models.

It is an advantage of the present invention to enhance consumer choices with respect to bowl design while preserving the toilet's performance capabilities.

It is also an advantage of the present invention to enable a single manufacturing facility to produce a variety of toilet configurations that are aesthetically and functionally suitable for each global location in which such toilets are sold.

It is another advantage of the present invention to stabilize opposing forces produced by conventional casting techniques and single component construction by providing an engine, shell and rim assembly.

In accordance with these and other advantages, the present invention provides a method and system of manufacturing a toilet from three or more component parts that are separately molded and subsequently assembled to form an integral piece. The three primary components include an outer shell that displays the toilet bowl's decorative contours, colors, textures and other aesthetic features; an inner engine (i.e., platform) that provides the toilet's functional features (trapway, jet, channels, etc.); and a rim that ensures complete cleaning of the bowl's inner surface and further ensures the discharge of waste in compliance with regionally established product standards.

In the disclosed method, each of the shell, engine and rim is individually formed as a solid cast component via a slip casting process. The desired component is desirably formed by introducing slip into individual filters under high-pressure (although gravity methods are also contemplated). Upon formation, the inner engine serves as a platform that is disposed within a hollow area defined by the shell's surface walls. One or both of an upper extent and a lower extent of the surface walls may include a ceramic sticking compound selectively applied thereon to ensure stable securement of the engine within the shell interior. Subsequently, the rim is placed in corresponding engagement with the shell and engine assembly so as to be supported thereby. The ceramic sticking compound may further be applied to the rim for additional securement with both the engine and shell. The three-piece assembly is subsequently finished, dried and fired to produce a single-piece toilet bowl. If additional features are desired (for instance, aesthetic frieze-type features or structural flanges on the exterior of the shell), these may be separately molded and affixed to the shell, engine and rim assembly before firing of the assembly in a conventional manner.

The assembly of the shell, engine and rim forms a solid component in which the slip is more compact and dense, thereby making each component structurally stronger. Because all of the primary components are produced as solid cast pieces and integrated into a single unit, all of the components are under a common stress that ensures uniform contraction. This inventive system therefore allows the design and construction of highly complex pieces with higher yields and productivity by utilizing special features previously only attained with high-pressure casting of modular components.

In addition to the structural advantages attained by the present inventive method and system, it is possible to produce a plurality of toilet models from a single platform by changing the design of the exterior surface of the shell. Toilet performance varies among geographic regions and toilets must comply with local sanitary standards. The present invention permits the specifications for the functional components to be fixed in the engine design. Once this is completed, common performance characteristics can be transferred among models and along entire product lines by employing the same engine configuration within a variety of shell and rim combinations. Similarly, it is possible to fix the exterior design characteristics of the exterior shell surface and transfer these to a variety of engine configurations so that a single toilet design may be offered with multiple engine specifications to attain different functional capabilities according to local regulations.

The present invention also substantially reduces the time between initial product conception and product commercialization by abbreviating the time required for test casting. Many manufacturers employ well utilized test casting methods to ensure that final products exhibit desired aesthetic and functional characteristics. The present invention significantly reduces the time and cost associated with test casting procedures, thereby requiring shorter development times to get the design and yields to commercially viable levels.

Various other advantages and features of the present invention will become readily apparent from the following detailed description, and the inventive features will be particularly evident from the appended claims.

DETAILED DESCRIPTION OF THE PREFERRED EMBODIMENTS

Figure 1:
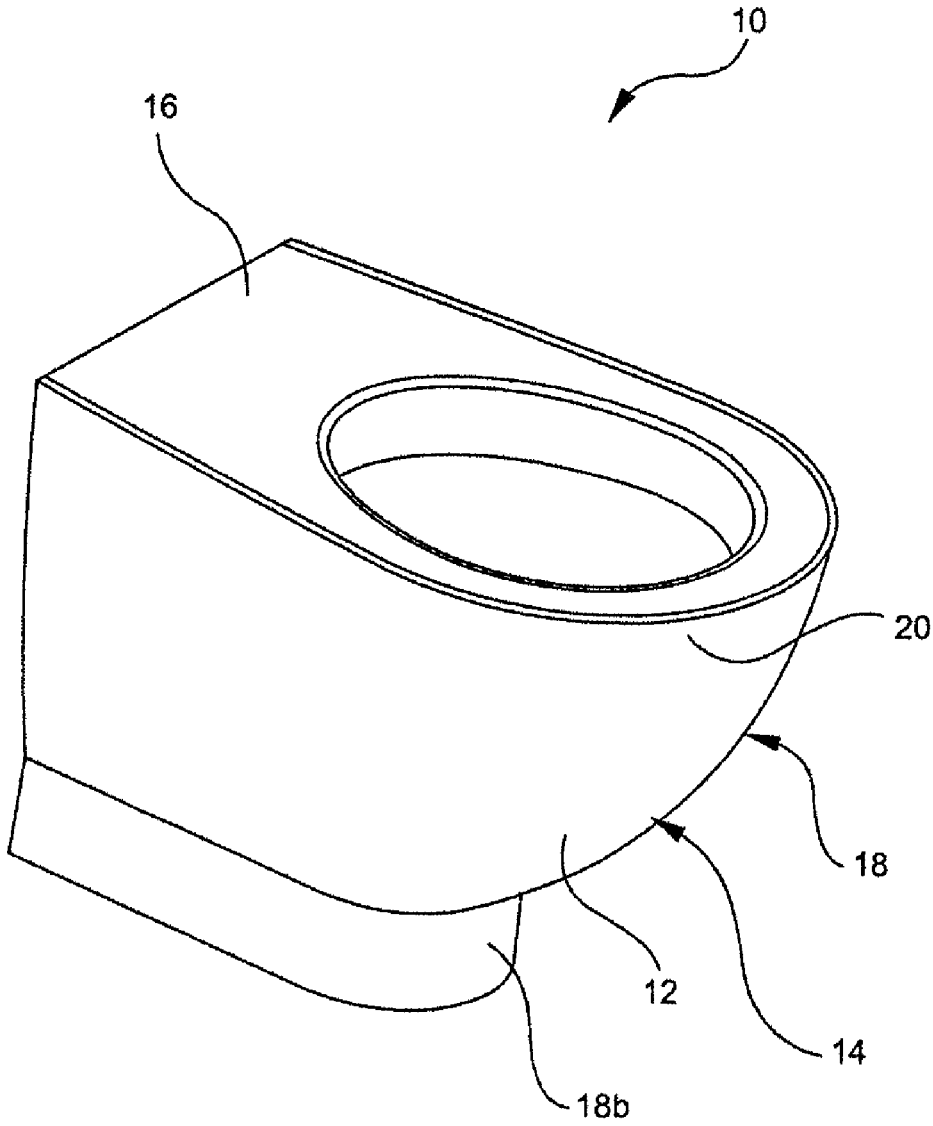
FIG. 1 is a perspective view of a toilet bowl manufactured in accordance with the system and method of the present invention.
Figure 2:
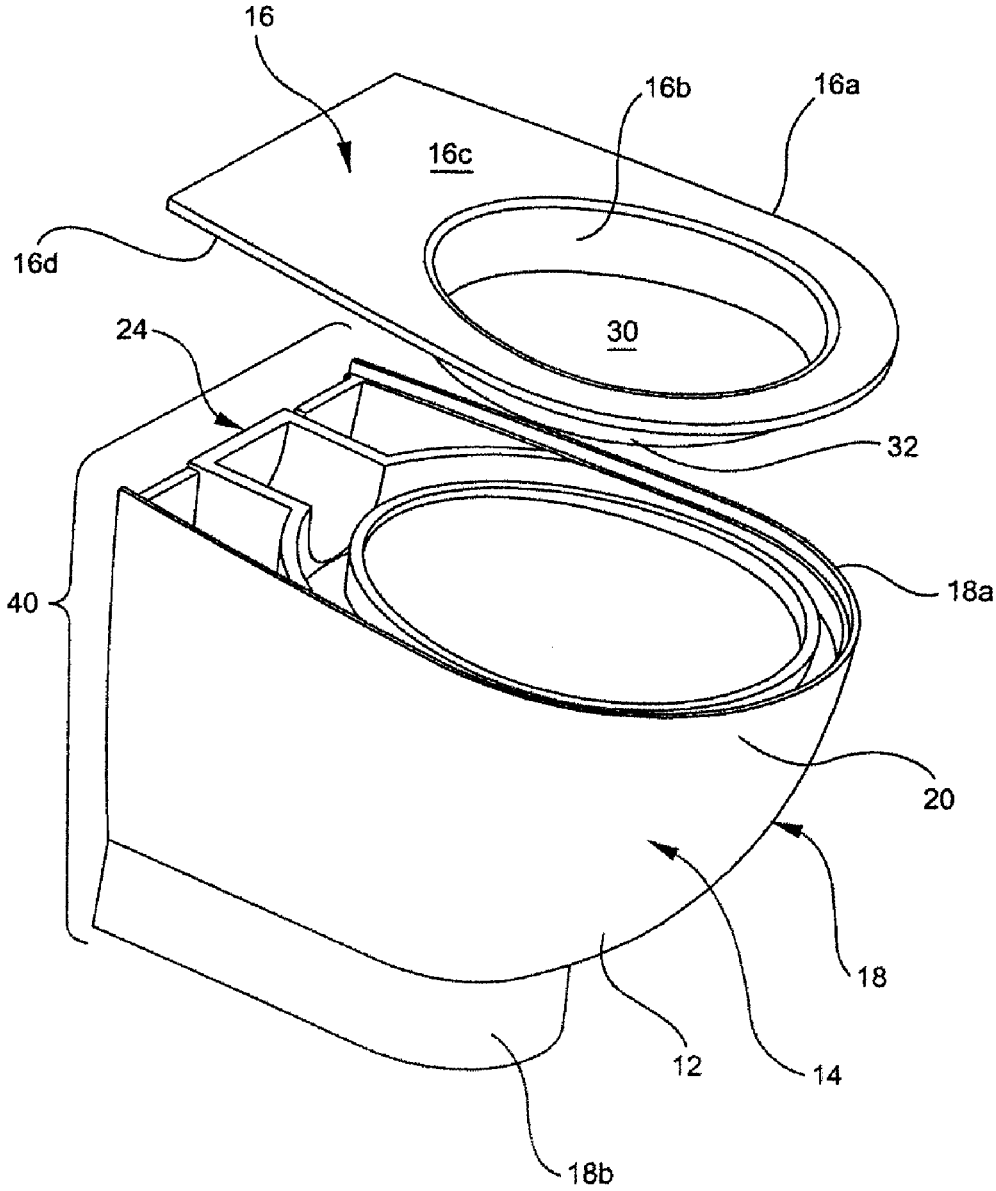
FIG. 2 is a partially exploded view of the toilet bowl of FIG. 1 having a rim removed therefrom to expose a performance engine disposed within an outer shell.
Figure 3:
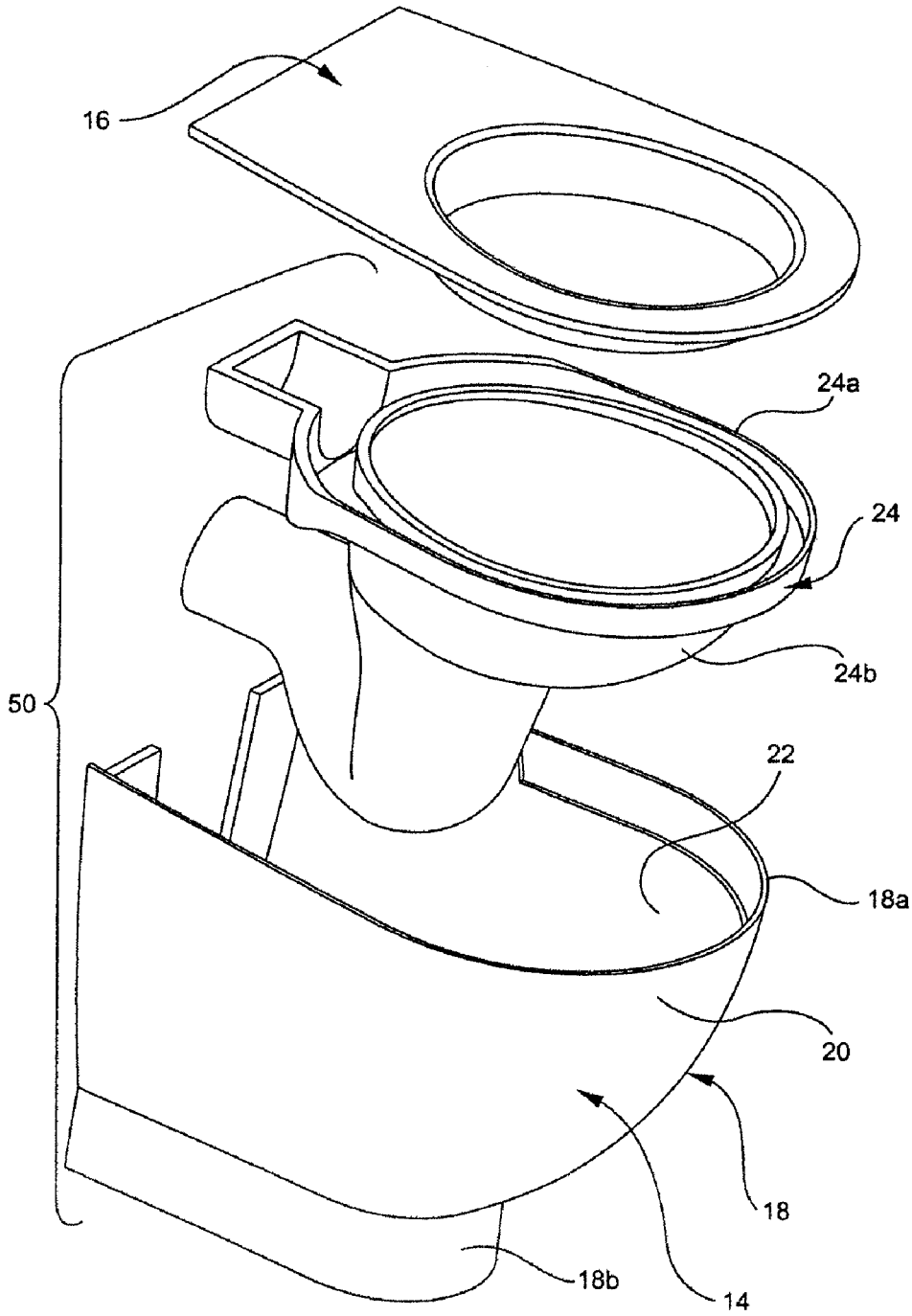
FIG. 3 is an exploded view showing an outer shell, an internal performance engine and a rim that are manufactured and assembled to make the toilet bowl of FIG. 1.
Figure 4:
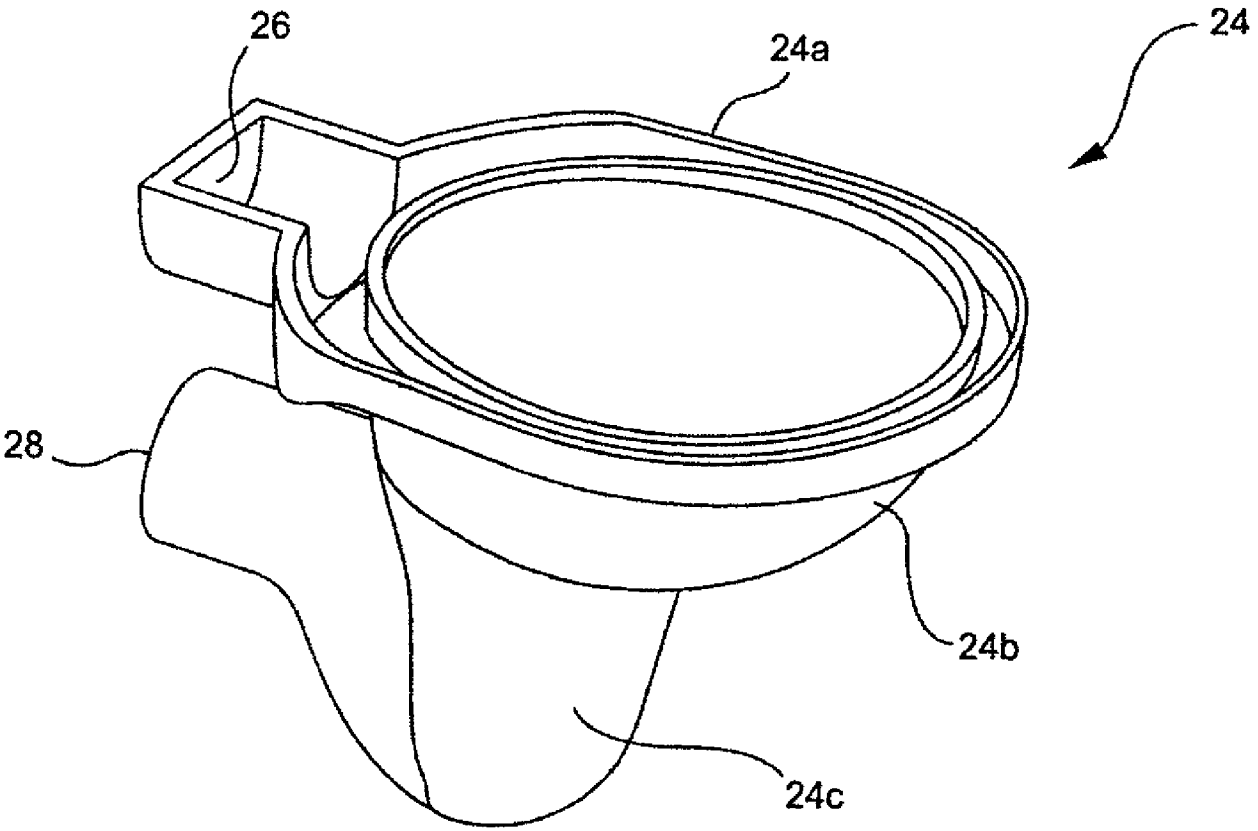
FIG. 4 is a perspective view of a performance engine used in the toilet bowl of FIG. 1.
Figure 5:
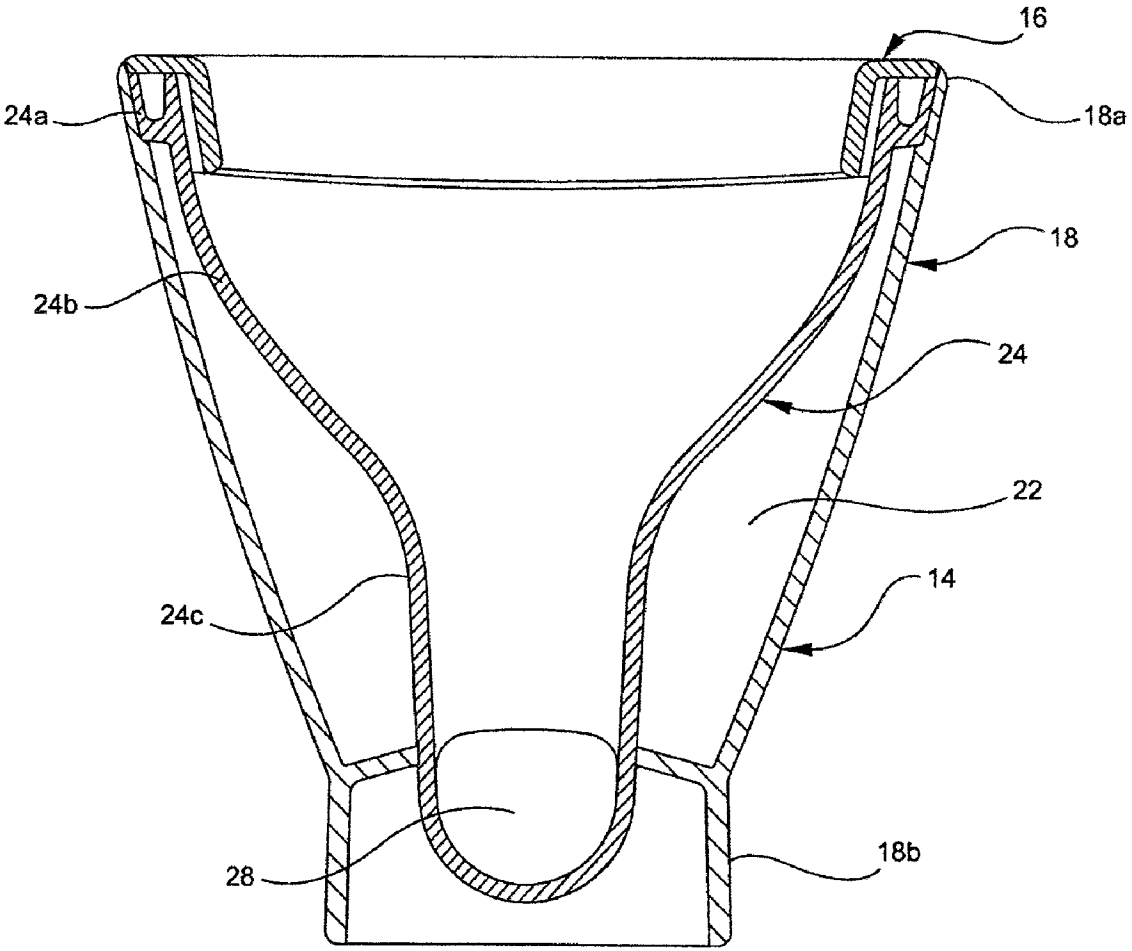
FIG. 5 is a longitudinal cross-sectional view of the assembled shell, engine and rim that comprise the toilet bowl of FIG. 1.
Figure 6:
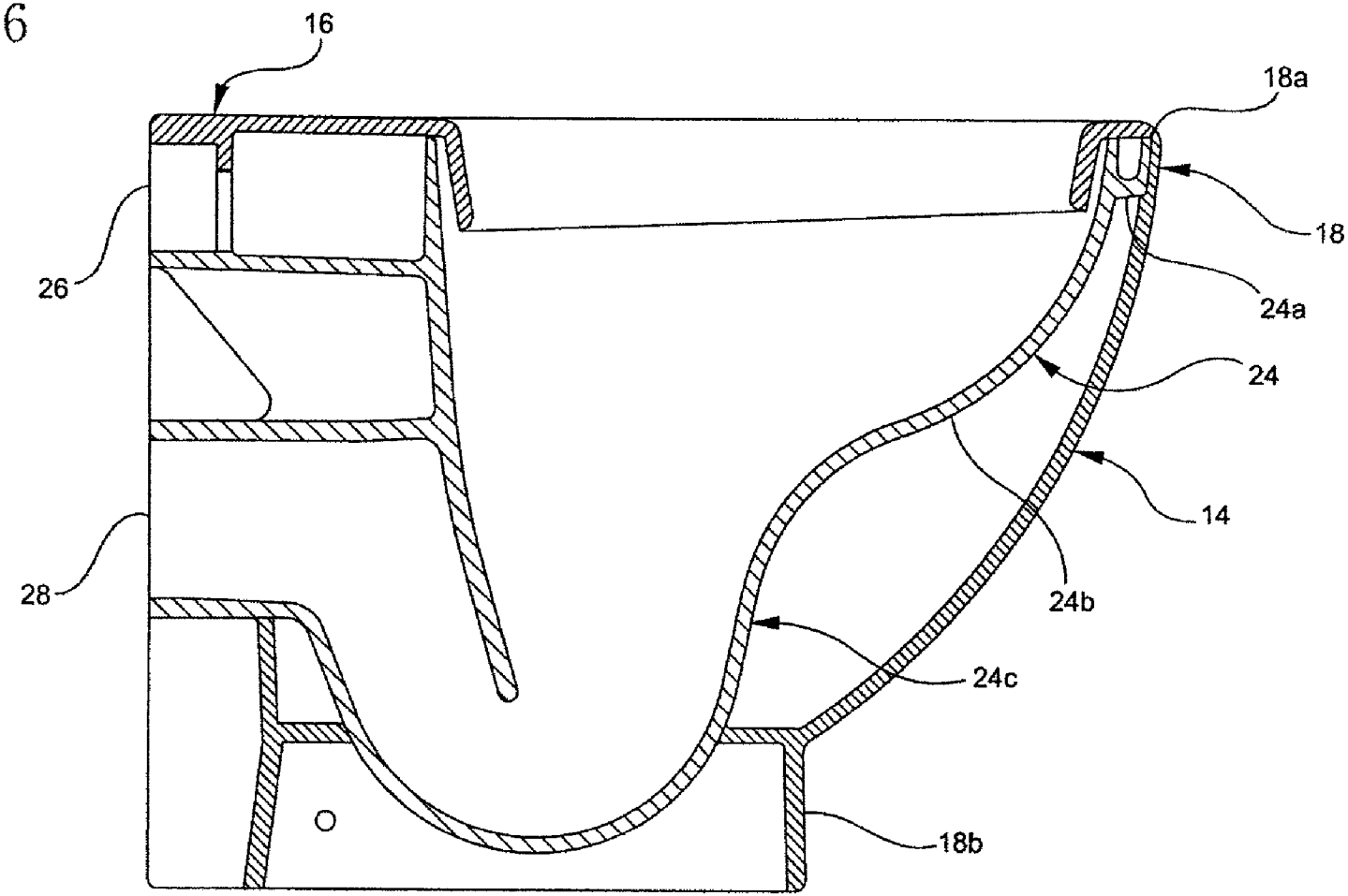
FIG. 6 is a lateral cross-sectional view of the assembled shell, engine and rim that comprise the toilet bowl of FIG. 1.
Figure 7:
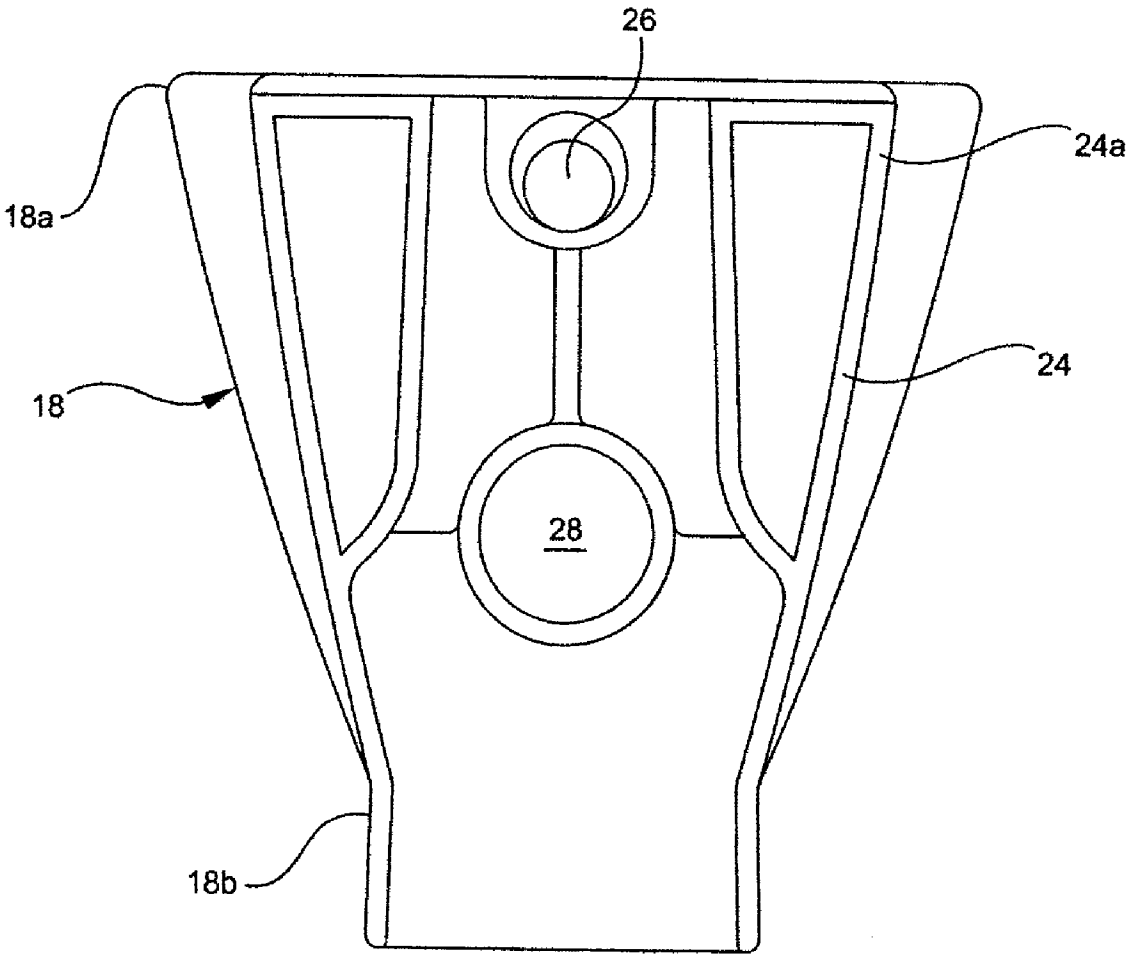
FIG. 7 is a rear elevation view of the toilet bowl of FIG. 1.
Figure 8:
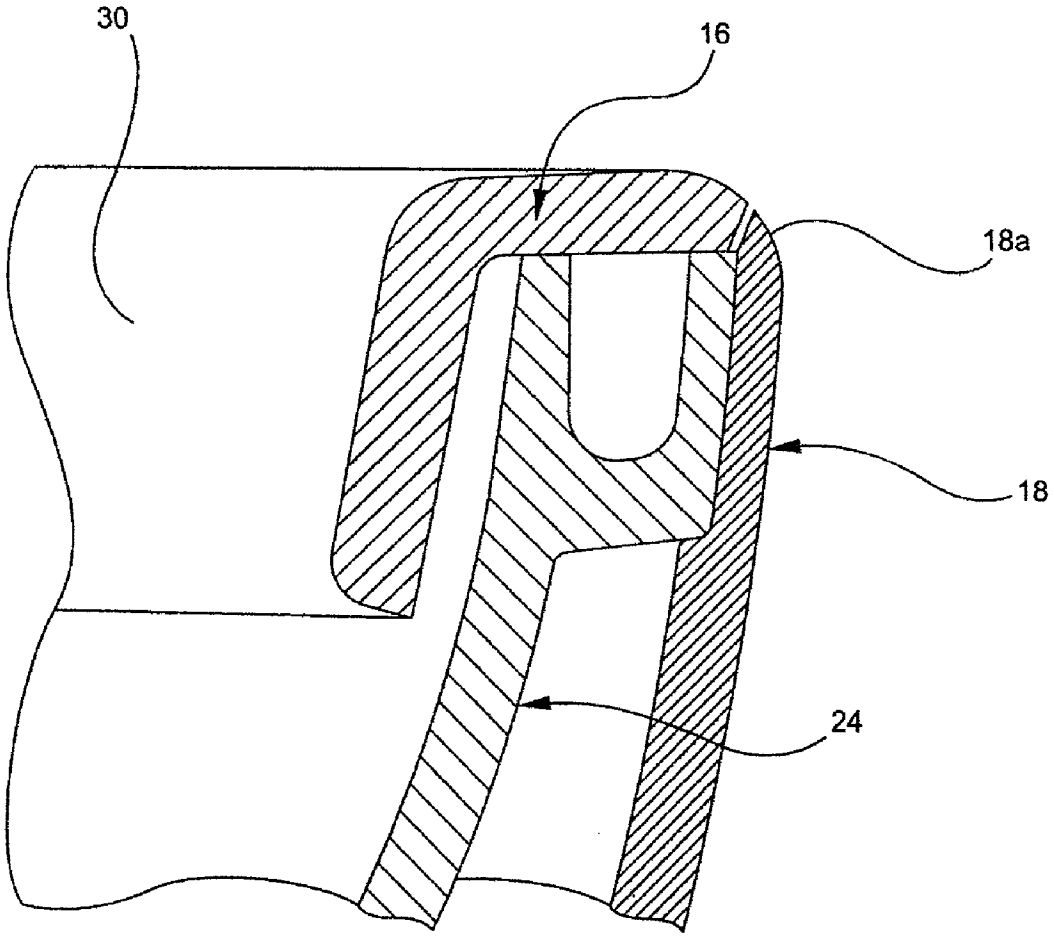
FIG. 8 is an enlarged view of section A of FIG. 6 showing the joinder of the shell, engine and rim that comprise the toilet bowl of FIG. 1.
Figure 9:
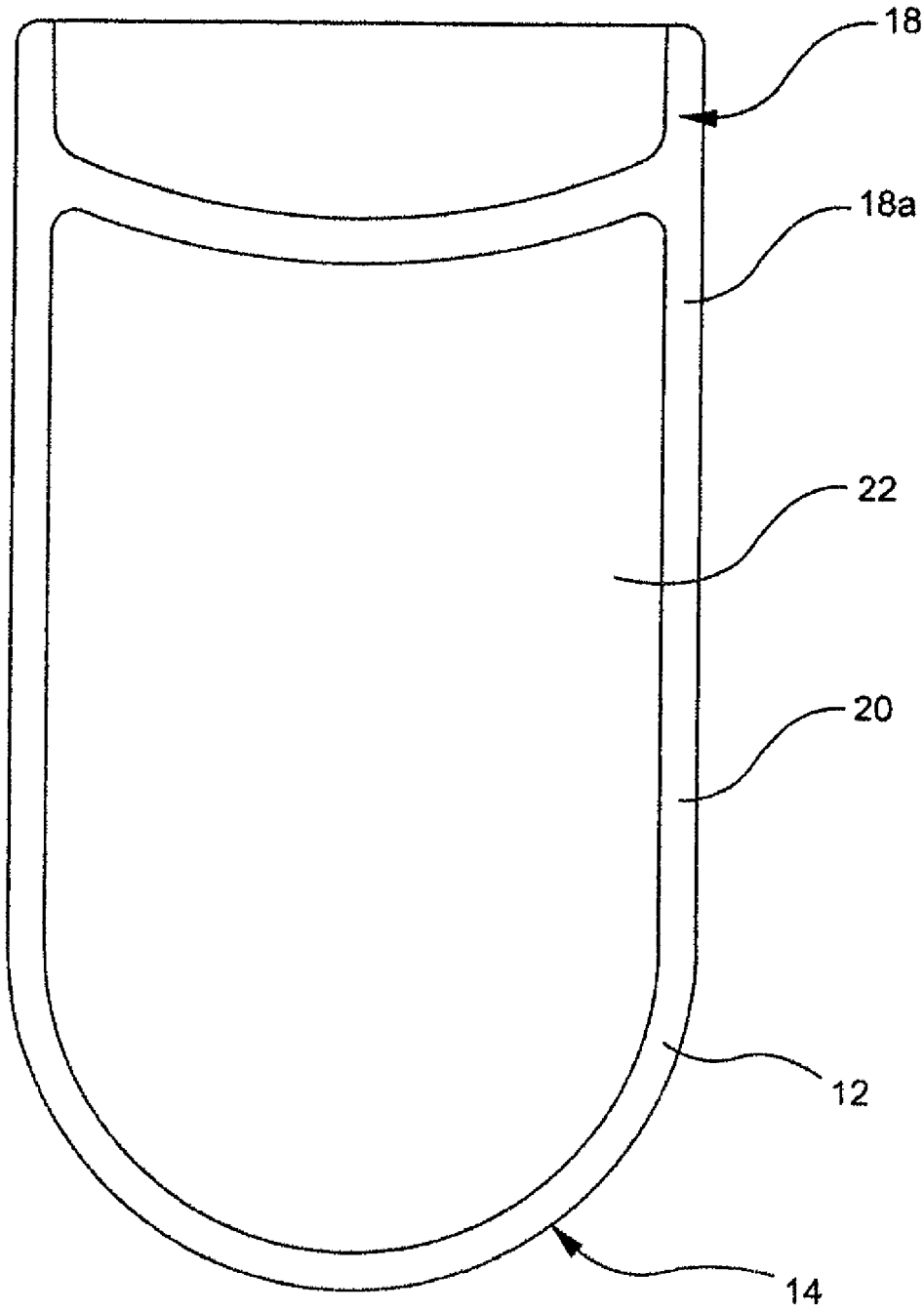
FIG. 9 shows a top plan view of a shell used in the assembly of the toilet bowl of FIG. 1.

The casting method of the present invention and a sanitary product obtained thereby are described with reference to the figures, wherein like reference numerals identify like elements.

Referring to FIG. 1, a finished one-piece toilet 10 is shown having a bowl 12 with a generally curved exterior surface 14 that supports a rim 16 integral therewith. Toilet 10 is produced from three primary components that are separately cast and subsequently assembled and fired to produce an integral piece of sanitaryware. Additional components may be cast as desired to achieve additional desired aesthetic appearances and structural integrity, although such additional components are not necessary for the successful performance of the present inventive method. One or more of the components may be treated with anti-bacterial, biocidal, deodorant, odor suppressing, anti-viral and/or algicidal agents to provide the finished toilet with enhanced hygienic properties.

Referring further to FIGS. 2 through 10, the exterior contour of bowl 12 is defined by a shell 18 which may be glazed with one or more finishes to provide a selected color, contour, texture, sheen or other desired aesthetic characteristic. Shell 18 has a rim portion 18*a* for placement of rim 16 thereadjacent and a base portion 18*b* that is secured to a support surface such as a floor. Shell 18 has a peripheral surface wall 20 defining the contours of exterior surface 14 of bowl 12 and further defining an internal hollow engine housing space 22 within which a performance engine 24 is disposed (as described further hereinbelow with reference to FIG. 4). After casting and drying, shell 18 may be treated with one or more glazes and treatments to achieve a desired color or texture. Laminar, impression, frieze or other designs may be incorporated along exterior surface 14 to achieve desired aesthetic effects. Shell 18 is amenable to production of both one-piece and two-piece toilet models and is not limited to the exact configuration shown. Shell 18 may assume any desired geometry that is amenable to successful practice of the present invention and that provides customers with a wide variety of design selections.

Engine housing space 22 receives performance engine 24 therewithin. As particularly illustrated in FIGS. 3 and 4, engine 24 includes a rim portion 24*a* that is generally coplanar with shell rim portion 18*a* and that, along with shell rim portion 18, accommodates placement of rim 16 thereadjacent. Engine 24 also includes a bowl portion 24*b* having a complementary contour relative to that of shell surface wall 20 so as to lie essentially thereadjacent. Engine 24 also includes trapway portion 24*c* in communication with a fluid inlet 26 and a fluid outlet 28 contiguous therewith. Engine 24 can alternatively accommodate one-piece and two-piece toilet constructions, and fluid inlet 26 may therefore comprise a fluid inlet that is in fluid communication with a separate toilet tank (not shown).

Engine 24 includes all of the functional elements that perform the water circulation in the bowl (such as jets and channels). Although engine 24 is shown as having a non-siphonic trapway, the present invention accommodates integration of a siphonic trapway during the design stage. The precise specifications of the fluid inlet and outlet, jets, channels and siphon may be modified according to the regulatory requirements and predominant plumbing systems of the local regions in which the toilet is sold. Engine 24 is therefore not limited to the specific bowl and trapway configuration shown but may include trapways of varying cross sectional shapes and size, jets of varying angular orientation and inlets and outlets of varying cross-sectional diameter. Such variances in engineering specifications are readily achieved in order to satisfy the regulatory standards and performance expectations of the region in which the toilet is sold, thereby ensuring predictable and repeatable performance in the manufacture of each bowl.

Rim 16 is molded separately and assembled with shell 18 and engine 24 to form toilet 10. Rim 16 includes an exterior periphery 16*a* and an interior periphery 16*b* defining an aperture 30 therethrough (see FIG. 2). Exterior periphery 16*a* and interior periphery 16*b* together define opposing upper and lower rim surfaces 16*c* and 16*d*, respectively, therebetween. The width defined between exterior periphery 16*a* and interior periphery 16*b* need not be uniform, and rim 16 may be specially designed with rim channels, slots, apertures or other features that enhance the waste removal features of the toilet. A peripheral protrusion 32 may extend from lower rim surface 16*d* to provide additional securement and enhanced alignment during mating with shell rim portion 18*a* and engine rim portion 24*a*.

All of the primary and secondary components are cast from molds that are already employed in prevalent high pressure and gravity slip casting methods. Such molds are typically fabricated from resin molds (high pressure methods) or plaster of Paris or a similar porous material (gravity methods), although the mold may be made from any material that is amenable to the successful practice of the present invention. A manufacturer may therefore readily execute the present inventive method using readily available equipment and employees already skilled in the use of such equipment without the need for additional training and capital expenditures.

Each component is cast from liquid slip that comprises multiple ingredients, including but not limited to talc, ball clay, feldspar, barium barbonate, soda ash, water and sodium silicate. The precise recipe for the slip may vary among designs and technical specifications and may further vary in consideration of ambient climate (i.e., ambient temperature and humidity). The percentage volume of each ingredient, and the required mixing time and speed of the slurry, are specific to individual manufacturers, and many manufacturers have their own proprietary recipes to which they make appropriate adjustments. Although the slip composition forms no part of the present invention, the present invention accommodates different slip recipes without compromising the desirable characteristics of the slurry, such as desired theological, plastic, recovery rate and firing range properties. The present invention method is therefore amenable to changes in the slurry recipe to achieve such desired properties.

Figure 14:
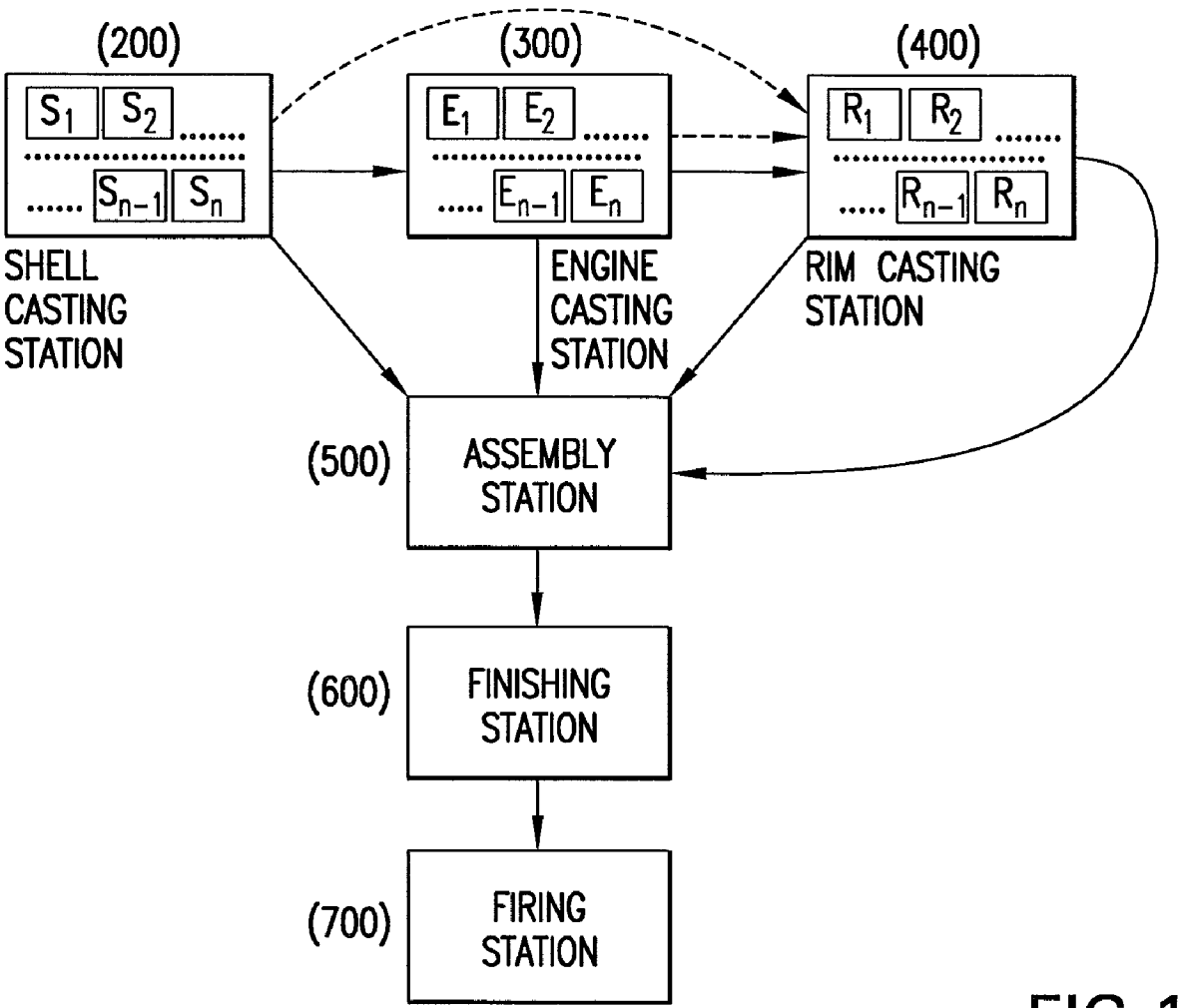
FIG. 14 shows a schematic drawing of manufacture of interchangeable elements by the system of the present invention.
Figure 15:
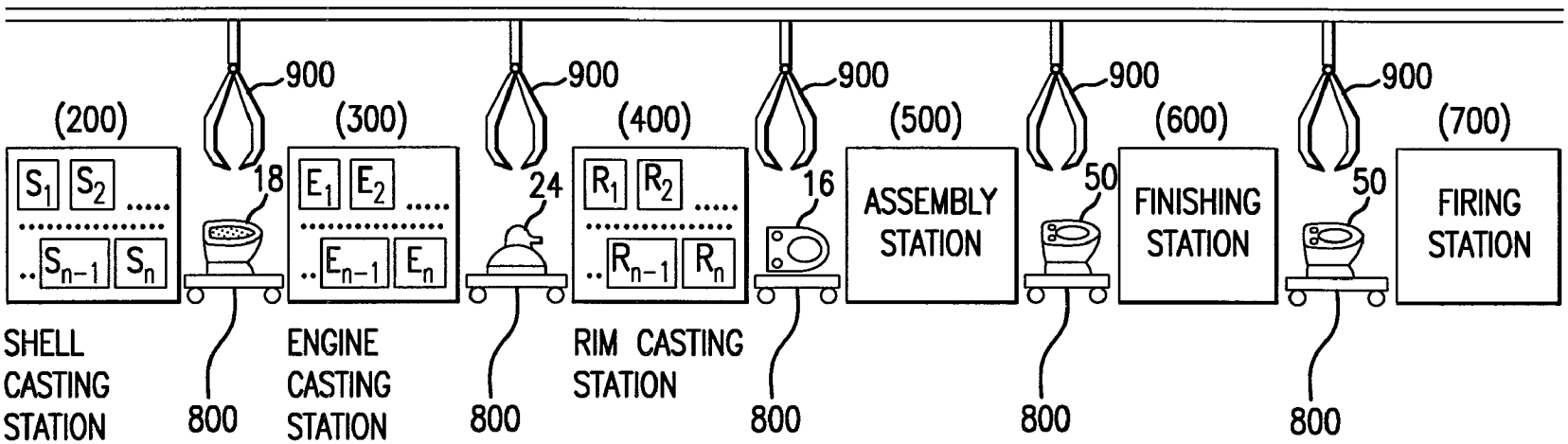
FIG. 15 shows a schematic drawing of the present inventive system having means for sequential direction of the interchangeable elements produced thereby.

Prior to performing any casting steps, the manufacturer must select the configuration for the shell, engine and rim that will be needed to produce toilet 10. As shown in FIG. 15, the manufacturer has at least one and up to N plurality of shell, engine and rim molds S, E and R, respectively, each of which defines a casting space to produce a unique configuration thereby. The molds are provided at corresponding shell, engine and rim casting stations 200, 300 and 400, respectively, that, in combination with separate assembly, finishing and firing stations 500, 600 and 700, respectively (collectively "casting stations"), define a casting sequence wherein a casting step is performed at each casting station. All or part of the casting sequence may be selectively repeated, since selected configurations can be sequentially directed through the casting stations (for instance, as by one or more casters 800 and/or one or more robotic arms 900 as shown in FIG. 15 among multiple stations as shown in FIG. 14) and a casting step performed thereon as needed (although not all configurations will require performance of each casting step in the sequence). Thus, the manufacturer must preliminarily select which of the unique shell, engine and rim configurations will be combined and the number of units to be produced.

Referring again to FIGS. 3 through 10, casting of shell 18 begins by providing at least one shell mold S selected from shell molds $S_1$ to $S_N$ (details of the shell mold are not shown) at shell casting station 200 (see FIGS. 14 and 15). The mold has front and back covers, top and bottom covers and side covers that together define a casting space within which the precise shape and contour of the configuration of shell 18 is defined. Slip is then poured through a mold inlet aperture that is in fluid communication with the casting space. Slip fills the casting space and drains therefrom through a mold outlet aperture. Such slip-pouring step may be performed at the shell casting station or at a separate slip pouring station (not shown). At the shell casting station, capillary action of pores within the mold removes water from the slip, thereby permitting the remaining clay to cure along the walls that define the casting space. After the clay achieves a satisfactory viscosity, shell 18 is removed from the mold while it remains in a green condition.

Engine 24 is similarly cast at an engine casting station 300 (see FIGS. 14 and 15) at which one or more distinct engine molds $E_1$ to $E_N$ are provided. Each engine mold defines a casting space therewithin from which a unique engine configuration is cast. Either at engine casting station 300 or a separate slip pouring station (which may be the same as the shell slip pouring station), slip is poured into a mold aperture that is in fluid communication with the casting space in the mold. After a sufficient mold time has elapsed, engine 24 is removed from the mold while still in a green condition.

Engine 24 may be molded in an inverted orientation such that a bottom cover of the mold remains in place to support greenware engine 24 thereon. At the engine casting station, a mechanical lift (i.e., at least one pair of robotic arms 900) can elevate engine 24 for placement in engine housing space 22 of shell 18. If necessary, one or more casters 800 can complement the lifting action of robotic arms 900 so as to invert engine 24 and insert trapway portion 24*c* thereof into engine housing space 22 (in this manner, the bottom cover now sits atop engine rim portion 24*a*). At a first assembly station, engine 24 is delicately lowered into engine housing space 22 until engine rim portion 24*a* is generally aligned with shell rim portion 18*a*. Engine 24 is set within engine housing space 22 so as to be immovably retained therewithin. The bottom cover of the mold is subsequently removed after engine 24 is completely inserted into engine housing space 22 and secured therewithin, revealing shell and engine assembly 40 (see FIG. 2).

At a separate rim casting station, rim 16 is separately cast in a similar manner as shell 18 and engine 24, that is, slip is poured into a casting space defined by top and bottom covers of a rim mold selected from at least one of rim molds $R_1$ to $R_N$. This slip pouring step is performed either at rim casting station 400 shown in FIGS. 14 and 15) or a separate slip pouring station which may be the same as one or both of the shell and engine slip pouring stations. After a sufficient mold time has elapsed, rim 16 is removed from the selected rim mold while still in a green condition. Casting of rim 16 in this manner enables the caster to extricate the cast rim from its mold by using a vacuum pick-up. This feature enhances casting productivity and safety by obviating the need for one or more casters to manually lift the heavy rim mold and transfer the rim to shell and engine assembly 40. Rim 16 is subsequently assembled with shell and engine assembly 40 at a second assembly station to produce shell, engine and rim assembly 50 (see FIG. 3).

Prior to assembly of shell 18 and engine 24 at the first assembly station, a ceramic sticking compound may be selectively applied to portions of peripheral surface wall 20, rim portion 18*a* and base portion 18*b* to promote securement and alignment of engine 24 within shell 18. The sticking compound, which may be selected from a variety of well-known compounds or may be a proprietary formulation, adheres shell 18 to engine 24 and ensures the integrity of the structural joints after firing. Sticking compound may be applied to one or both of shell rim portion 18*a* and engine rim portion 24*a* prior to placement of rim 16 thereadjacent to similarly promote sufficient coupling and alignment of rim 16 relative to shell and engine assembly 40. Application of the sticking compound may be executed at a separate application station.

Although all three of the primary components may be simultaneously cast, the intricate specifications of a particular toilet model may inherently vary the casting times for each component. It is noted that high-pressure casting permits the production of multiple components in a high-pressure casting machine that automatically controls the casting cycle and obviates casting cycle variances.

Figure 10:
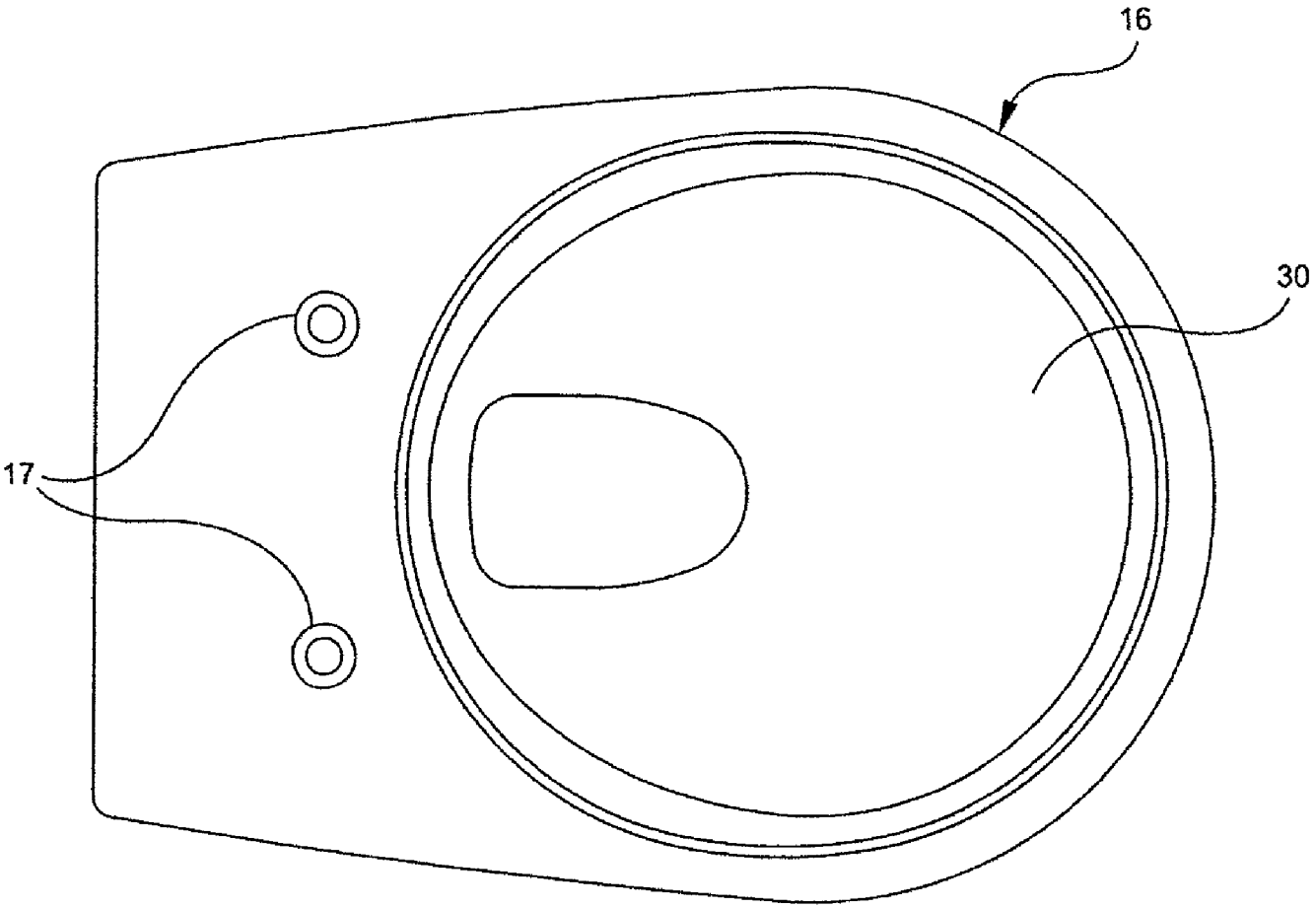
FIG. 10 shows a top plan view of an assembled toilet bowl wherein a rim used in the assembly has apertures for attachment of a separate toilet seat or tank thereto.

Now referring to FIGS. 14 and 15, prior to firing of assembly 50 at a separate firing station 700, rim 16 may be directed to a finishing station 600 at which one or more rim apertures 17 may be punched within rim 16 so as to accommodate securement of a separate toilet seat or toilet tank thereto (see FIG. 10). Also at finishing station 600, one or more of case shell 18, engine 14 and rim 16 may be treated with glazes to attain desired aesthetic properties selected from, but not limited to, color, sheen, texture and a combination thereof. Additionally, any of the shell, engine and rim may be treated with one or more anti-bacterial, biocidal, deodorant, odor suppressing, anti-viral and/or algicidal agents as described hereinabove.

Also, additional molded components (secondary components) that are separately cast from the shell, engine and rim may be combined with assembly 50 at the finishing station to achieve enhanced structural integrity and aesthetic appeal. Each component may be inserted into a channel designed into the periphery of the bowl rather than stuck on as is the case with a conventional bowl, thereby providing a finite seam which is invisible after glazing and firing.

Because a solid dense wall is now formed on all surface and components of the bowl, even setting and curing of the walls is attained, thereby eliminating inherent stresses thereon. Unlike conventional casting methods, the present inventive system and method permits selective volume production of a large variety of bowls of complex design. The toilet bowl cast according to the method of the present invention is designed to ensure that the walls of the cast piece are solid throughout and can be assembled to produce complex structures that remain free of defects and design limitations. The systematic method of assembling the primary components (shell, engine and rim) requires only existing slip recipes and molds to produce complex parts and designs. All pieces or segments are solid cast and therefore under similar stresses, unlike current processes that employ a mix of solid and hollow cast areas that create stress and consequential losses that lower manufacturing performance.

Figure 11:
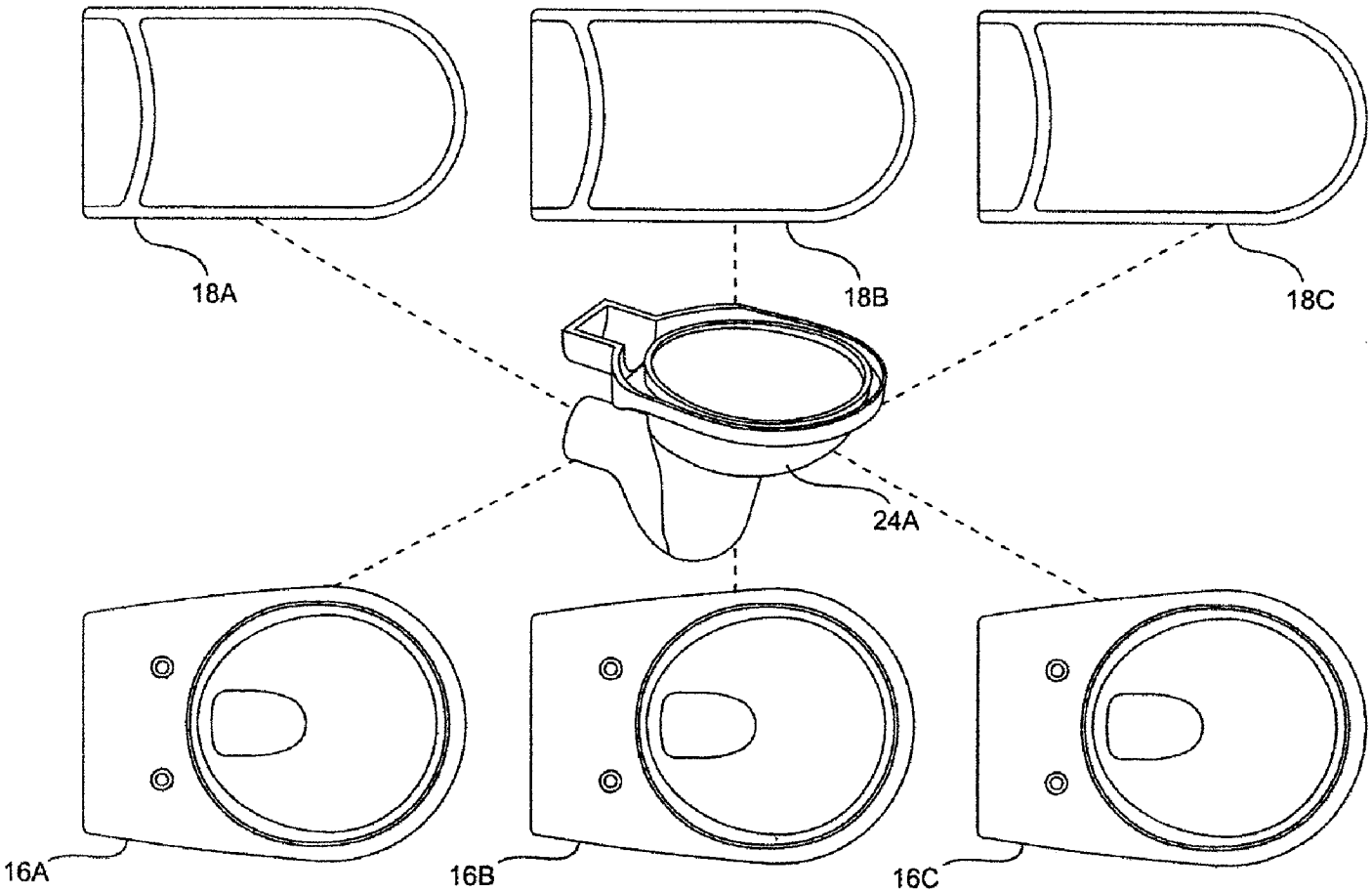
FIG. 11 shows a schematic drawing of possible combinations of three different shell configurations and three different rim configurations with a single engine configuration.
Figure 12:
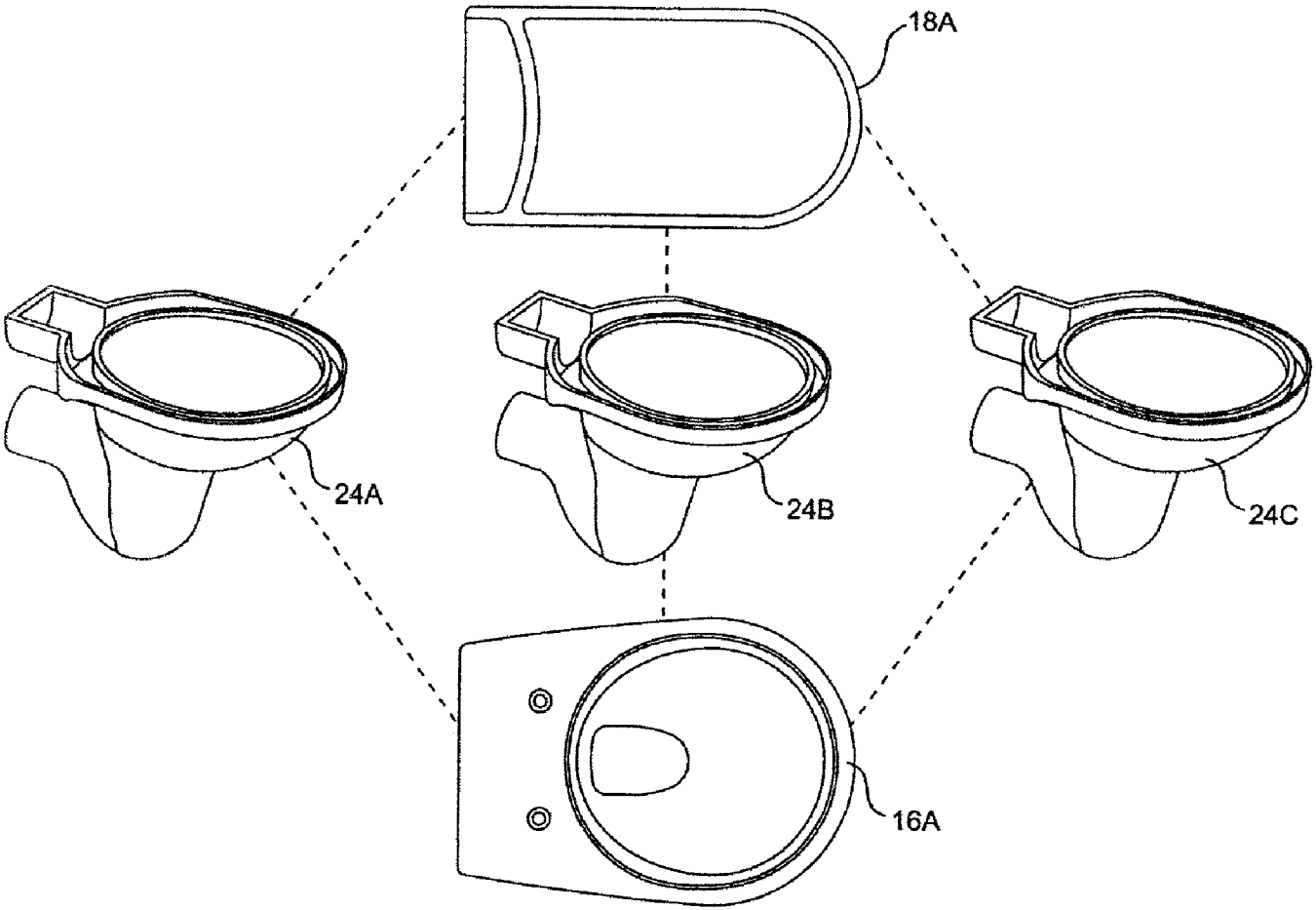
FIG. 12 shows a schematic drawing of possible combinations of three engine configurations with a single shell configuration and a single rim configuration.
Figure 13:
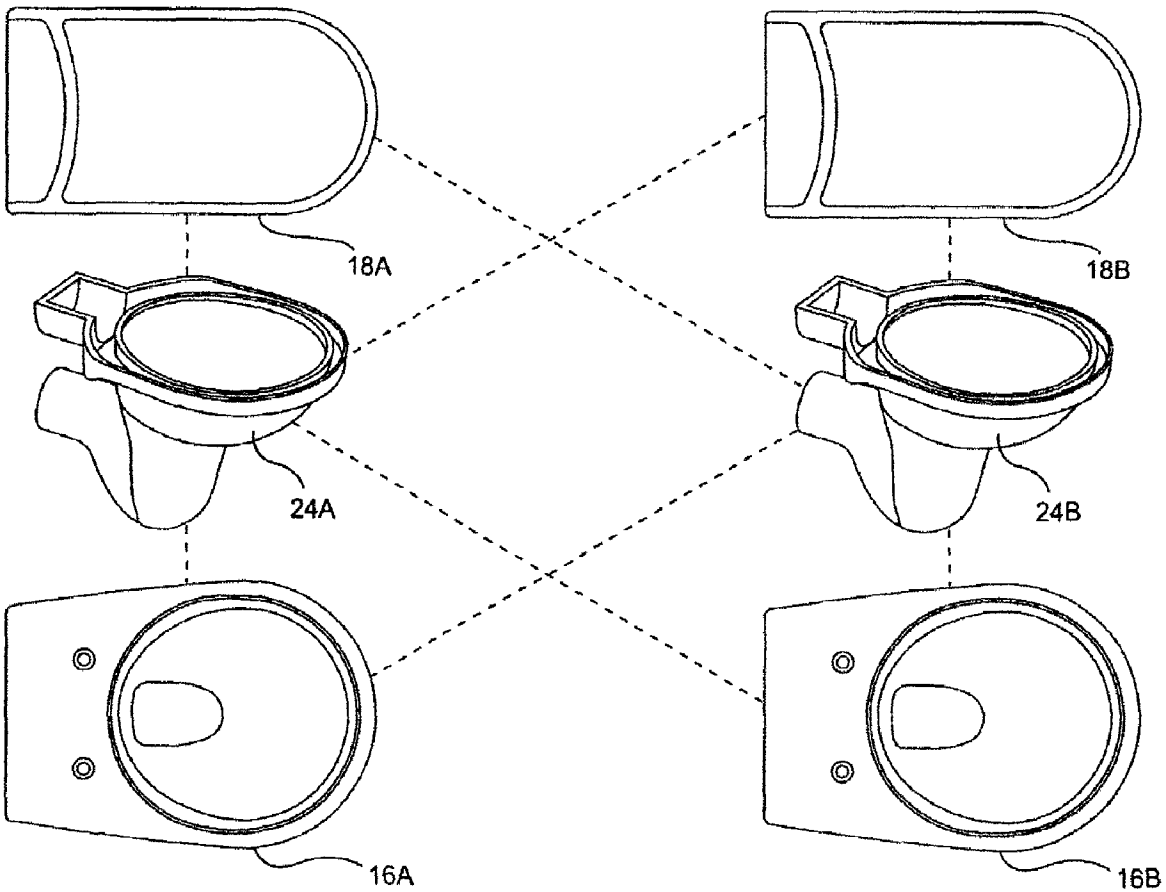
FIG. 13 shows a schematic drawing of possible combinations of pairs of shell, engine and rim configurations.

Referring to FIGS. 11, 12 and 13, the enhanced manufacturing efficiency of the present invention is illustrated. FIGS. 11, 12 and 13 show combinations of different shell, engine and rim configurations that are possible using the present inventive system and method. The illustrated design combinations are shown in the following table, although it is understood that such combinations are made by way of example only and that many more configurations may be produced to attain an infinite number of different shell, engine and rim assemblies.

| | | FIG. 11 | FIG. 12 | FIG. 13 |
|---|---|---|---|---|
| Shell Configuration | 18(A) | X | X | X |
| | 18(B) | X | | X |
| | 18(C) | X | | |
| Engine Configuration | 24(A) | X | X | X |

-continued

| | | FIG. 11 | FIG. 12 | FIG. 13 |
|---|---|---|---|---|
| | 24(B) | | X | X |
| | 24(C) | | X | |
| Rim Configuration | 16(A) | X | X | X |
| | 16(B) | X | | X |
| | 16(C) | X | | |

FIG. 11 shows possible combinations of a single engine configuration 24(A) with three shell configurations 18(A), 18(B) and 18(*c*) and three rim configurations 16(A), 16(B) and 16(C). As an example, the local regulations in a particular geographic sales region may require toilet 10 to have the functional capabilities attained by engine 24(A). The manufacturer can comply with the regulations and still offer multiple choices of models in the same region by disposing engine 24(A) within each one of shell configurations 18(A), 18(B) and 18(C). The manufacturer may further select one of rims 16(A), 16(B) and 16(C) in consideration of local aesthetic preferences, prevailing spatial parameters of rooms within which toilet 10 is installed or the functional requirements of a tank and flush valve assembly with which bowl 12 is further assembled (if bowl 12 is produced as part of a two-piece toilet model).

FIG. 12 similarly shows possible combinations of a single shell configuration 18(A) with a single rim configuration 16(A) and three engine configurations 24(A), 24(B) and 24(C). Thus, a popular model constructed with shell 18(A) and rim 16(A) may be sold in multiple geographic regions by selecting one of engine configurations 24(A), 24(B) or 24(C). The engine configuration is selected in consideration of local regulations and performance requirements. Thus, compliance with regional regulations is assured while preserving the recognition of the design in an extended sales region.

FIG. 13 shows possible combinations of pairs of shell configurations 18(A) and 18(B), engine configurations 24(A) and 24(B) and rim configurations 16(A) and 16(B). The shell, engine and rim configurations are interchangeable in consideration of the ultimate geographic region in which sanitaryware will be sold. Thus, a manufacturing facility that is centrally located relative to multiple geographic sales regions can satisfy the demand for diverging aesthetic demand yet comply with the local regulations of each region in which such sanitaryware is sold.

The present invention thus overcomes high losses and continuously incurred production shortages inherent in conventional slip casting. The structure is designed to allow the manufacture of complex sanitaryware, namely one-piece bowls, shrouded bowls and other complex items produced in multi-parts molds. Such complex items are currently produced by drain casting methods where high stresses are generated on common solid and hollow casting areas over large inner and outer surfaces of the bowls. Such stresses ensure low yields and limit design variations in the product. The principle and design of the shell, engine and rim assembly is to eliminate such forces through the manufacture and assembly of the three primary components as a single integral piece of sanitaryware. Simultaneously, the system establishes a common platform ("engine and rim") to which innumerable shell designs can be added while changing the aesthetic appearance and maintaining product integrity. By employing a predictable and easily reproducible method, the system further eliminates design restrictions, improves productivity and raises yields similar to simple bowl/water closet designs.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A system for manufacturing a plurality of toilet models from interchangeable elements, comprising:

a series of molds for making said interchangeable elements, said molds including at least one shell mold, each said at least one shell mold having a casting space for casting a selected shell configuration thereby, said shell configuration having a housing space for disposition of a performance engine therewithin; at least one engine mold, each said at least one engine mold having a casting space for casting a selected performance engine configuration thereby; and at least one rim mold, said at least one rim mold having a casting space for casting a selected rim configuration thereby; wherein any said selected shell, engine or rim configuration is interchangeable with any corresponding non-selected shell, engine or rim configuration to comprise said interchangeable elements;

a series of casting stations defining a casting sequence wherein each said casting station accommodates performance of at least one casting step thereat; and means for sequentially directing said selected configuration to at least one casting station selected from said series of casting stations, each said casting station having at least one casting step performed thereat on at least one said interchangeable element in said selected configuration;

said sequential directing means repeating sequential direction of said selected configuration until a predetermined plurality of toilet models is obtained thereby.

2. A system according to claim 1, wherein said series of stations includes a shell casting station for using at least one said shell mold to cast said selected shell configuration, each said shell configuration having a rim portion to accommodate placement of said rim configuration thereadjacent, a base portion for securement of said shell configuration to a support surface and a peripheral surface wall having an exterior surface that defines an external contour of said selected shell configuration and an interior surface that defines an internal contour of said housing of said shell configuration.

3. A system according to claim 2, wherein said series of stations includes an engine casting station for using said at least one engine mold to cast said selected engine configuration, each said engine configuration including an engine rim portion that is generally coplanar with said shell rim portion and that, along with said shell rim portion, accommodates placement of said rim configuration thereadjacent; a bowl portion having a contour complementary to said peripheral surface wall of said shell configuration and a trapway portion in communication with a fluid inlet and a fluid outlet contiguous therewith.

4. A system according to claim 3, wherein said series of stations includes a rim casting station for using said at least one rim mold to cast said selected rim configuration, each said rim configuration including an exterior periphery and an interior periphery together defining an aperture therethrough, said exterior and interior peripheries together defining opposing upper and lower rim surfaces, respectively, thereby.

5. A system according to claim 4, wherein a peripheral protrusion may extend from said lower rim surface for mating with at least one of said shell rim portion and said engine rim portion to provide additional securement thereby.

6. A system according to claim 4, wherein said series of stations includes an application station for applying sticking compound to at least one of said selected cast shell, engine and rim configurations.

7. A system according to claim 4, wherein said series of stations includes a first assembly station for assembling said selected cast shell and engine configurations and to provide at least one shell and engine assembly therefrom.

8. A system according to claim 7, wherein said series of stations includes a second assembly station for assembling said at least one selected cast rim configuration with said at least one shell and engine assembly to derive at least one shell, engine and rim assembly therefrom.

9. A system according to claim 8, wherein said series of stations includes a finishing station having means for treating at least a portion of said at least one said shell, engine and rim assembly with one or more finishes of selected color, contour, texture, sheen or any combination thereof.

10. A system according to claim 9, wherein said finishing station includes means for treating at least a portion of said at least one said shell, engine and rim assembly with at least one of an anti-bacterial, biocidal, deodorant, odor suppressing, anti-viral and algicidal agent.

11. A system according to claim 8, wherein said series of stations includes a firing station having means for firing said interchangeable elements after casting to derive single-piece toilets thereby.

12. A system according to claim 1, wherein any selected configuration of said shell, engine and rim configurations is amenable to combination with any non-selected configuration of said shell, engine and rim configurations.

* * * * *